US007798433B2

(12) United States Patent
Onishi et al.

(10) Patent No.: US 7,798,433 B2
(45) Date of Patent: Sep. 21, 2010

(54) FUEL INJECTION VALVE DEVICE

(75) Inventors: Yoshihiko Onishi, Tokyo (JP); Shigenobu Tochiyama, Tokyo (JP); Kazunori Kitagawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 851 days.

(21) Appl. No.: 11/375,263

(22) Filed: Mar. 15, 2006

(65) Prior Publication Data

US 2007/0095948 A1 May 3, 2007

(30) Foreign Application Priority Data

Oct. 27, 2005 (JP) ..... P 2005-312416

(51) Int. Cl.

| | |
|---|---|
| ***F02M 59/00*** | (2006.01) |
| ***F02M 51/00*** | (2006.01) |
| ***B05B 1/30*** | (2006.01) |
| ***B05B 1/00*** | (2006.01) |
| ***B21K 21/08*** | (2006.01) |

(52) U.S. Cl. ..... 239/600; 239/533.2; 239/584; 239/585.5; 239/596; 239/DIG. 19; 29/890.143

(58) Field of Classification Search ..... 239/518, 239/524, 533.1, 533.2, 533.3, 533.12, 585.5, 239/596, 600, DIG. 19; 29/890.143
See application file for complete search history.

(56) References Cited

U.S. PATENT DOCUMENTS 5,881,957 A * 3/1999 Mizuno et al. ..... 239/533.2
6,039,271 A * 3/2000 Reiter ..... 239/585.4
2005/0040259 A1* 2/2005 Dallmeyer et al. ..... 239/533.12

FOREIGN PATENT DOCUMENTS

| | | | |
|---|---|---|---|
| JP | 61-209777 | A | 9/1986 |
| JP | 09-317607 | A | 12/1997 |
| JP | 10-122096 | A | 5/1998 |
| JP | 10-123276 | A | 5/1998 |
| JP | 2002-130085 | A | 5/2002 |
| JP | 2003-206828 | A | 7/2003 |
| JP | 2004-60519 | A | 2/2004 |
| JP | 2004-169572 | A | 6/2004 |
| JP | 2004-346358 | A | 12/2004 |
| WO | WO 98-01665 | A1 | 1/1998 |
| WO | WO 98-28538 | A1 | 7/1998 |
| WO | WO 2005/033501 | A1 | 4/2005 |

* cited by examiner

*Primary Examiner*—Dinh Q Nguyen
*Assistant Examiner*—Ryan Reis
(74) *Attorney, Agent, or Firm*—Sughrue Mion, PLLC

(57) ABSTRACT

A fuel injection valve device is capable of thinning a nozzle hole plate and improving fuel spray characteristics by a construction for reducing stress concentration that occurs at the weld part of the nozzle hole plate. The fuel injection valve device includes: a nozzle having a fuel passage inside and in which a valve seat is formed at an end; a needle valve for opening and closing the fuel passage by coming in contact with and separating from the valve seat; and an nozzle hole plate that is disposed at the tip of the nozzle and injects a fuel in the fuel passage at the time of opening the needle valve. The nozzle hole plate and the nozzle are fixed by welding in a state of forming an even gap between them.

10 Claims, 3 Drawing Sheets

FUEL INJECTION VALVE DEVICE

BACKGROUND OF THE INVENTION

1. Field of the Invention

The present invention relates to a fuel injection valve device for use in, for example, automobile engines and, more particularly, to a fuel injection valve device provided with a nozzle hole plate for atomization of fuel.

2. Description of Related Arts

Under the recent trend of tightening the regulations of exhaust gas, in the field of fuel injection valve device for use in automobile engines, it has been increasingly demanded to improve fuel spray characteristics. To cope with this demand, several attempts of fuel injection valve device have been proposed. In those known fuel injection valve devices, a nozzle hole plate having a plurality of nozzle holes on the downstream side of a valve member consisting of a valve disc and a valve seat is disposed so that atomized fuel is injected from every nozzle hole into each cylinder head of an engine.

For example, the Japanese Patent Publication (unexamined) No. 2004-169572 discloses a fuel injection valve device in which a first nozzle hole plate having vertical cylindrical holes is joined by welding on the tip (downstream side) of the valve member, and a second nozzle hole plate having an inclined cylindrical holes that are larger hole diameter than the mentioned vertical cylindrical holes and communicate with the cylindrical holes of the mentioned first nozzle hole plate is further welded in a superimposed manner on the downstream side of the mentioned first nozzle hole plate, thereby atomization of fuel being carried out.

The Japanese Patent Publication (unexamined) No. 2003-206828 discloses another fuel injection valve device provided with a valve seat for discharging or interrupting the fuel from the injector by engaging or disengaging with a valve seat moving up and down; and a nozzle plate (nozzle hole plate) having a plurality of orifices directly welded and fixed onto the valve seat on the downstream side; and in which the mentioned orifices are shaped into a circular corn spreading toward the downstream side; thereby atomization of fuel and improvement in quality of exhaust gas being achieved.

The Japanese Patent Publication (unexamined) No. 317607/1997 discloses a further fuel injection valve device in which a nozzle plate (nozzle hole plate) is cup-shaped, and a protruding face of a bottom part of this nozzle plate is welded onto a sleeve fixed to a valve member side so as to press the protruding face on the end face of an opening of the valve member, thereby it being avoided to directly fixing the nozzle hole plate to the valve member in order to suppress deflection produced on the bottom part of the mentioned nozzle plate due to fuel injection pressure.

SUMMARY OF THE INVENTION

To improve fuel spray characteristics such as atomization in the fuel injection valves, it has been conventional to adopt such means as increasing fuel pressure, thinning a nozzle hole plate or the like. In such means, however, the fuel injection valve for cylinder injection of fuel is normally high in fuel pressure (for example, 20 MPa), and therefore when thinning the nozzle hole plate, deflection of the nozzle hole plate becomes large due to application of fuel pressure. Thus, a problem exists in that stress concentration is easy to occur at a notch part between the nozzle hole plate and the weld part of the nozzle. To cope with this, it has been necessary to increase strength of the nozzle hole plate, which eventually results in a large-scaled fuel injection valve.

In the case of the fuel injection valve device disclosed in the Japanese Patent Publication (unexamined) No. 2004-169572, the welding and fixation are made only at the end part of the valve member 5 and the end face of the fitting part of the second nozzle hole plate 9. In the case of the fuel injection valve device disclosed in the Japanese Patent Publication (unexamined) No. 2003-206828, the welding and fixation are made (from underside) only at the end face of the fitting part of the nozzle plate (nozzle hole plate) 24 fitted to the end part of the valve seat 16. Furthermore, in the case of the fuel injection valve device disclosed in the Japanese Patent Publication (unexamined) No. 317607/1997, the nozzle plate (nozzle hole plate) 61 and the sleeve 71 welded to the valve member 26 (at the weld part 91) are welded only at the outer circumference (at the weld part 92). In every foregoing art, the welding of the nozzle hole plate is made only at the end face or on the side face, and a notch part remains at the tip of the nozzle hole plate. Therefore, a stress concentration takes place at this notch part, which may result in a fatigue failure even in case of a minute deflection due to moment of the nozzle hole plate caused by high fuel pressure. Thus, there has been a limit in application of high fuel pressure or thinning the nozzle hole plate.

The present invention was made to solve the above-discussed problems, and has an object of providing a fuel injection valve device capable of thinning a nozzle hole plate and expanding a adjustable range of fuel spray characteristics by a construction for reducing stress concentration that occurs at the weld part of the nozzle hole plate.

A fuel injection valve device according to the invention includes: a nozzle having a fuel passage inside thereof and in which a valve seat is formed at an end; a needle valve for opening and closing the mentioned fuel passage by coming in contact with and separating from the mentioned valve seat; and an nozzle hole plate that is disposed at the tip of the mentioned nozzle and injects a fuel in the mentioned fuel passage at the time of opening the mentioned needle valve. The mentioned nozzle hole plate and the nozzle are fixed by welding in a state of forming an even gap between them.

In the fuel injection valve device of above construction according to the invention, since coefficient of stress concentration applied to a notch part at the tip of the weld part can be made small, deflection of the nozzle hole plate is suppressed and moment produced at the time of welding is made small. As a result, there is an advantage such that thickness of the nozzle hole plate can be established as small as possible even in case of high fuel pressure.

The foregoing and other objects, features, aspects and advantages of the present invention will become more apparent from the following detailed description of the invention when taken in conjunction with the accompanying drawings.

DESCRIPTION OF THE PREFERRED EMBODIMENTS

Embodiment 1

Figure 1:
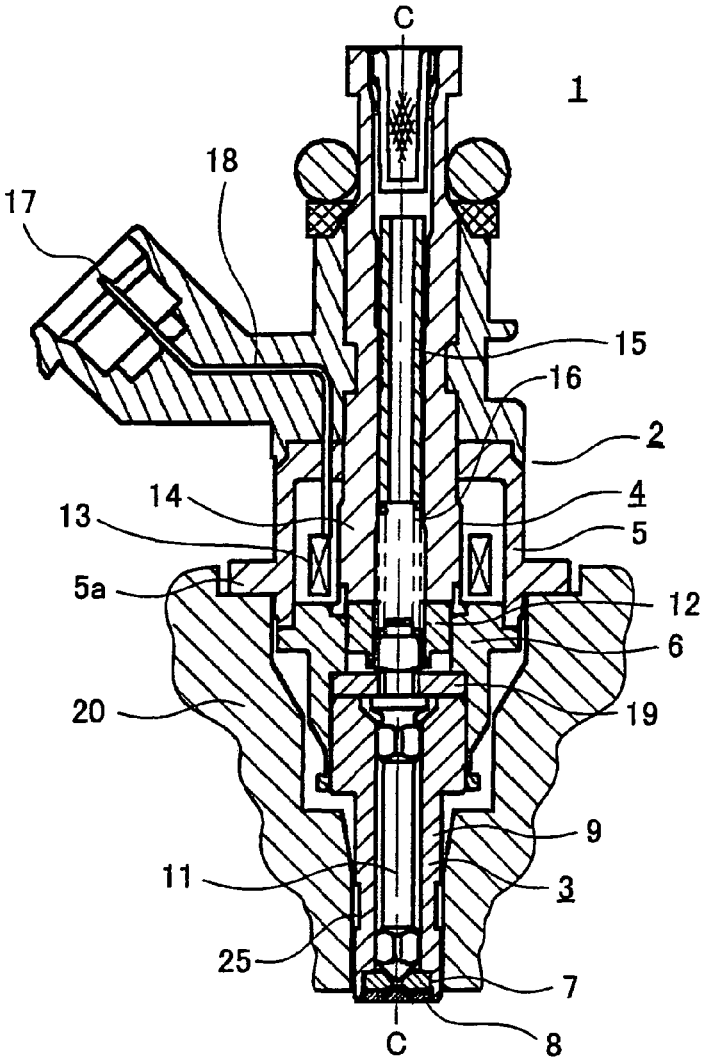
FIG. 1 is a longitudinal sectional view showing an entire construction of a fuel injection valve device according to Embodiment 1 of the present invention.
Figure 2:
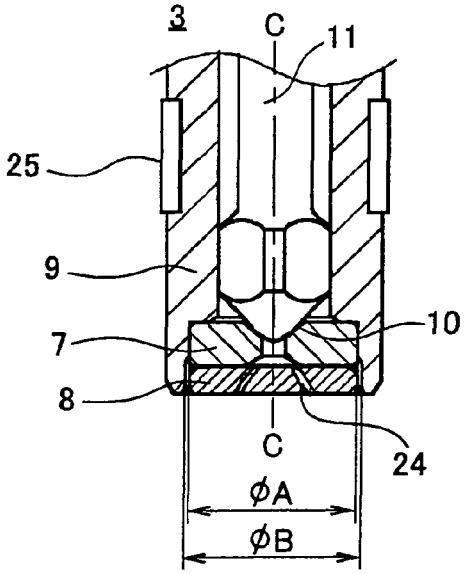
FIG. 2 is an enlarged view showing an essential part of a tip part of the valve device of FIG. 1.

Embodiment 1 of the invention is hereinafter described with reference to the accompanying drawings. FIG. 1 shows a longitudinal sectional view of an entire construction of a fuel injection valve device according to Embodiment 1 of the present invention, and FIG. 2 shows an enlarged view of an essential part of a tip part of the valve device of FIG. 1. Referring to FIGS. 1 and 2, a fuel injection valve 1 mainly consists of a housing 2, a nozzle member 3 disposed inside at the end part of this housing 2, and a solenoid part 4 disposed inside at the intermediate part of the housing 2.

The mentioned housing 2 consists of a yoke part 5 having a flange 5*a* for mounting the fuel injection valve 1 on a cylinder head 20, and a holder 6 connected to one and of the yoke part 5. The mentioned nozzle member 3 is shaped into a cylinder provided with steps, and consists of a nozzle 9 to which a valve seat 7 and a nozzle hole plate 8 are fixed at the tip by a later-described method; a needle valve 11 that is slidably inserted in the mentioned nozzle 9 so as to open and close a valve seat contact part 10 by moving up and down on the center axis C of the mentioned valve member 3; and a moving iron core 12 joined by welding to the mentioned needle valve 11 at the upper end thereof.

The mentioned solenoid part 4 consists of a coil 13 on which copper wires are wounded; a cylindrical stationary iron core 14 mounted on the inner circumference of the mentioned coil 13; a rod 15 fixed to the internal part of the mentioned stationary iron core 14; a compression spring 16 disposed between an end of the mentioned rod 15 and an end of the needle valve 11 to urge the needle valve 11 on the valve seat 7; and a terminal 17 for connecting a lead wire of the coil 13 to outside via a housing part 18.

Now, operations of the mentioned fuel injection valve 1 are described. When a valve opening signal from a controller (not illustrated) is inputted via the terminal 17 to the coil 13, magnetic flux generated in the coil forms a magnetic circuit consisting of the stationary iron core 14, moving iron core 12, holder 6 and yoke part 5, and generates an electromagnetic force attracting the moving iron core 13 to the side of the stationary iron core 14. By the moving up action of the moving iron core, the needle valve 11 also moves to the side of the stationary iron core 14, thus valve opening of the nozzle member 3 being performed. At this time, an opening area of the valve seat contact part 10 is determined by a lifting amount that is regulated by contact of the valve 11 with a stopper 19.

On the other hand, when the valve opening signal is inputted from the controller, the conduction of current to the coil 13 is interrupted, and the mentioned electromagnetic attraction is vanished. Accordingly, the moving iron core 12 and the needle valve 11 are moved away from the side of the stationary iron core 14 by the urging force of the compression spring 16, thus valve closing of the nozzle member 3 being performed.

Fuel injection is carried out when the tip of the needle valve 11 of the fuel injection valve 1 releases the valve seat contact part 10. As for the sealing force of the needle valve 11, the compression spring 16 disposed in the internal part of the mentioned stationary iron core 14 is set to a predetermined compressive force by the rod 15. Accordingly, a sealing force is determined depending upon a compressive force of the compression spring 16 and a fluid force produced by a fuel pressure applied to the seat area of the valve seat contact part 10.

In addition, the fuel injection valve 1 is mounted on the cylinder head 20 via a ring 25 of Teflon (registered trademark). This ring 25 seals combustion flame within the engine cylinder. However, a nozzle part located under the ring 25 is exposed to the flame.

Figure 3:
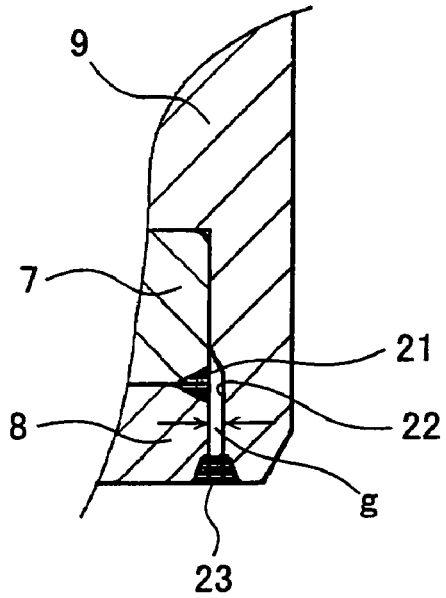
FIG. 3 is a partially enlarged view to explain a state of a valve seat and a nozzle hole plate mounted on the tip part of a nozzle member of FIG. 2.

FIG. 3 is a partially enlarged view to explain a state of mounting the valve seat 7 and nozzle hole plate 8 on the tip part of the mentioned nozzle member 3. In the drawing, first the valve seat 7 is laid out concentrically with the nozzle hole plate 8, and the valve seat 7 having been welded on the nozzle hole plate 8 at the outer circumference (indicated by the weld part 21) is press-fitted to the nozzle 9. At this time, note that only the valve seat 7 is press-fitted, so that a step 22 is formed on the nozzle 9, thereby an even gap g being formed on the entire circumference. Such a gap g is formed on the outer circumference of the nozzle hole plate 8 for the purpose of absorbing the eccentricity between the nozzle hole plate 8 and the valve seat 7 and, at the same time, suppressing the stress concentration on the weld part.

That is, the nozzle hole plate 8 and the valve seat 7 are joined at the periphery thereof through the weld part 21. It is, however, very difficult to lay out the nozzle hole plate 8 and the valve seat 7 accurately in a perfectly concentric manner, and actually an eccentricity is somewhat produced. As a result, a slight displacement comes out at any part of the periphery. When press-fitting such eccentrically jointed member into the nozzle 9, a strain stress toward the joint portion will be disadvantageously produced. To avoid such disadvantage, only the valve seat 7 is press-fitted, so that an even gap g is formed on the entire circumference. In addition, the gap g is set to have dimensions enabling to weld, e.g., not more than 0.2 mm in difference of diameter. By seal welding between the ends of the nozzle hole plate 8 and the nozzle 9, the mentioned gap g is completely closed with welding beads. This portion is indicated by weld part 23.

End of the mentioned weld part 23 is not a conventionally notch-shaped but is U-shaped having a certain radius of curvature, so that coefficient of stress concentration is small. Accordingly the stress produced at the end of weld part can be made small. Further, by making a radius of curvature larger, the coefficient of stress concentration can be made smaller. Furthermore, since the nozzle 9 and nozzle hole plate 8 are joined together by welding through the gap g thereby being U-shaped at the weld part, the conventionally employed equipment can be used as they are. In addition, under the conditions of different welding depth between the nozzle 9 and nozzle hole plate 8 including a case of large difference in physical properties of material between them or a case where a target welding position is extremely displaced toward the nozzle 9 side or the nozzle hole plate 8 side, any notch may be produced. Accordingly, it is desirable that the nozzle 9 and nozzle hole plate 8 are composed of the same material by adopting, for example, austenitic stainless steel, ferritic stainless steel, or martensitic stainless steel. It is also desirable that the target welding position is located between the nozzle 9 and nozzle hole plate 8.

As described above, according to Embodiment 1 of the invention, the valve seat 7 and the nozzle hole plate 8 are welded at the outer circumference thereof, thereby forming stepped hole laid out so as to fit only the valve seat 7 to the nozzle 9, and then the nozzle hole plate 8 and the nozzle 9 are welded so as to have an even gap g between them. In this manner, a weld part moderating the notch is obtained, whereby coefficient of stress concentration on the notch can be reduced. As a result, deflection of the nozzle hole plate produced at the time of applying a fuel pressure is suppressed, and moment produced at the weld part is reduced, making it possible to set the thickness of the nozzle hole plate smaller.

Figure 4:
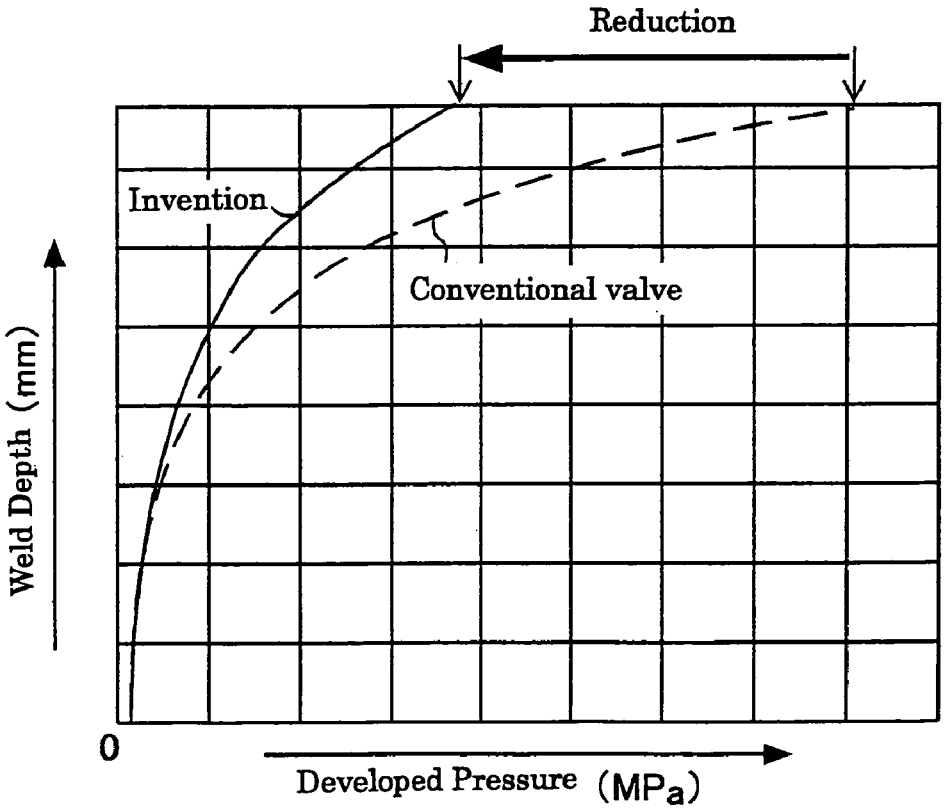
FIG. 4 is a graphic diagram of stress produced at the tip of the weld part at the time of operating the fuel injection valve according to Embodiment 1 of the invention.

FIG. 4 shows distribution of stress produced in the weld part at the time of operating the fuel injection valve in comparison with that of the conventional valve. In the drawing, the axis of ordinates indicates weld depth in mm, and the axis of abscissas indicates developed pressure in Mpa. It is understood from this drawing that the larger the weld depth is the less the stress is.

Embodiment 2

Figure 5:
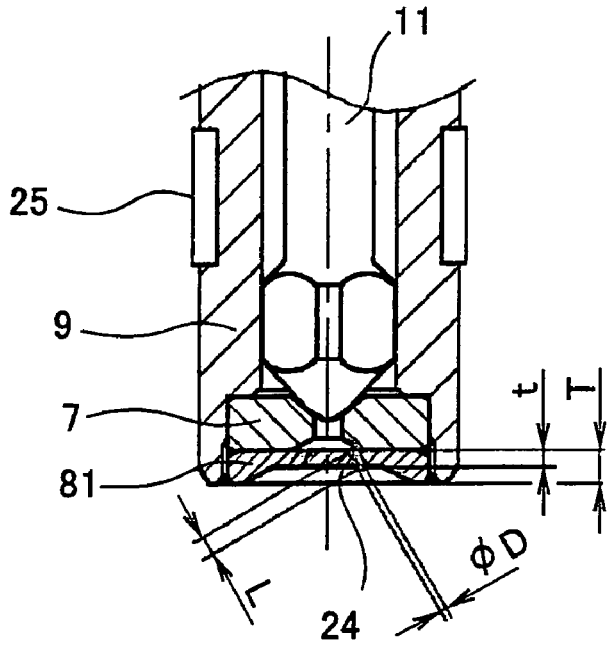
FIG. 5 is an enlarged view showing an essential part of a tip part of the valve device according to Embodiment 2 of the invention.

Now referring to FIG. 5, Embodiment 2 of the invention is described. In this Embodiment 2, the same construction as in the foregoing Embodiment 1 is employed except that configuration of a nozzle hole plate is different. More specifically, in the nozzle hole plate 81 of this Embodiment 2, a thickness T of the outer circumference thereof is formed to be larger than a thickness t of the central part in order to suppress the moment due to fuel pressure of the nozzle hole plate. A plurality of inclined jet holes 24 is formed on this nozzle hole plate 81. Supposing that length of a jet hole 24 is L, diameter of the jet hole 24 is D, it has been acknowledged that atomization of fuel liquid injected through the mentioned jet holes 24 is desirably controlled by appropriately setting a ratio between L and D, i.e., L/D. In addition, it is preferable that the thickness T is set to be in the range of 1.0 to 1.5 mm and the thickness t is in the range of 0.4 to 0.7 mm.

Generally it is preferable that L is set to be smaller in the atomization carried out by deflection of the fuel flowing through inside the jet holes 24. When L is smaller, the time of contact between fuel and air in the jet holes 24 is shorter, and an amount of air mixed with the fuel flow becomes less enabling to perform fuel injection of high purity. Accordingly, atomization characteristics of fuel are improved by thinning the central part where the jet holes 24 are located, while the outer circumferential part being thickened, thereby securing a mechanical strength with respect to welding and the like. As a result, this Embodiment 2 provides a more preferable fuel injection control valve.

Embodiment 3

Figure 6:
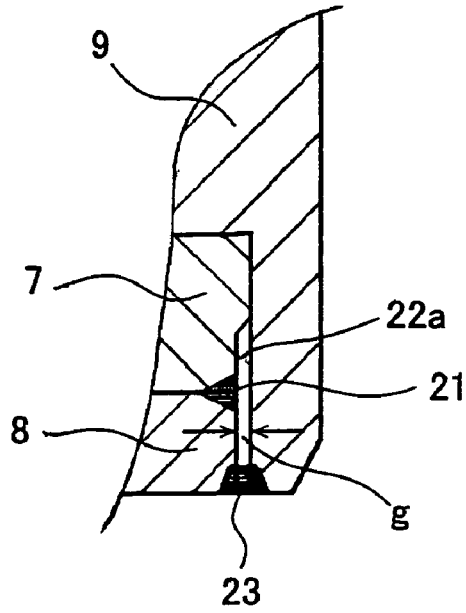
FIG. 6 is a partially enlarged view to explain a state of a valve seat and a nozzle hole plate mounted on the tip part of a nozzle member according to Embodiment 3 of the invention.

Now, referring to FIG. 6, Embodiment 3 of the invention is described. FIG. 6 is an enlarged view of an essential part of a tip of a valve member 3 of a fuel injection valve 1 and corresponds to FIG. 3 of the foregoing Embodiment 1. In this Embodiment 3, the same construction as in the foregoing Embodiment 1 is employed except that configuration of a gap 22*a* is different. That is, in the foregoing Embodiment 1, a step portion 22 is formed on the end of the nozzle in order to provide an even gap g on the entire circumference between the nozzle hole plate 8 and the nozzle. On the other hand, in this Embodiment 3, a step portion 22 is formed on the valve seat 7 and nozzle hole plate 8 side in order to provide an even gap g. As a result of such construction, since it is not necessary to apply any machining for forming the gap to the nozzle 9, a nozzle can be configured with high accuracy.

What is claimed is:

1. A fuel injection valve device comprising: a nozzle having a fuel passage inside thereof and in which a valve seat is formed at an end; a needle valve for opening and closing said fuel passage by coming in contact with and separating from said valve seat; and an nozzle hole plate that is disposed at the tip of said nozzle and injects a fuel in said fuel passage at the time of opening said needle valve; wherein said nozzle hole plate and the nozzle are fixed by welding in a state of forming an even gap therebetween, wherein the even gap between the nozzle and the nozzle hole plate is provided along an entire outer circumference of the nozzle hole plate in a thickness direction starting from a first weld part where the nozzle and the nozzle hole plate are fixed by welding to at least a second weld part where the nozzle hole plate and the valve seat are fixed by welding, such that the gap at the first weld part is equal to the gap at the second weld part.

2. The fuel injection valve device according to claim 1, wherein said valve seat and the nozzle hole plate are concentrically disposed, end faces of said valve seat and the nozzle hole plate being welded to each other at outer edges along a circumference thereof at the second weld part, and only said valve seat is press-fitted to the nozzle.

3. The fuel injection valve device according to claim 1, wherein said gap between the nozzle and the nozzle hole plate is set to be not more than 0.2 mm in difference of diameter.

4. The fuel injection valve device according to claim 1, wherein said gap between the nozzle and the nozzle hole plate is formed by providing the nozzle with a step.

5. The fuel injection valve device according to claim 1, wherein said gap between the nozzle and the nozzle hole plate is formed by providing the nozzle hole plate with a step.

6. The fuel injection valve device according to claim 1, wherein the first weld part between said nozzle hole plate and the nozzle is U-shaped.

7. The fuel injection valve device according to claim 1, wherein a thickness T of an outer circumference of said nozzle hole plate is formed to be larger than a thickness t of the nozzle plate at a central part thereof.

8. The fuel injection valve device according to claim 7, wherein the thickness T is set to be in the range of 1.0 to 1.5 mm and the thickness t is in the range of 0.4 to 0.7 mm.

9. The fuel injection valve device according to claim 1, wherein said nozzle and the nozzle hole plate are composed of the same material.

10. The fuel injection valve device according to claim 9, wherein said nozzle and the nozzle hole plate are composed of stainless steel.

* * * * *